US006105326A

United States Patent [19]

Schmidt-Lutz

[11] Patent Number: 6,105,326

[45] Date of Patent: Aug. 22, 2000

[54] BUILDING, COMPRISING PREFABRICATED COMPONENTS

[76] Inventor: Rolf Schmidt-Lutz, Ullrich-Burggrafstrasse 7, 89349 Burtenbach, Germany

[21] Appl. No.: 08/716,276

[22] PCT Filed: Mar. 15, 1995

[86] PCT No.: PCT/DE95/00355

§ 371 Date: Nov. 4, 1996

§ 102(e) Date: Nov. 4, 1996

[87] PCT Pub. No.: WO95/27106

PCT Pub. Date: Oct. 12, 1995

[30] Foreign Application Priority Data

Mar. 30, 1994 [DE] Germany ..... 44 11 122

[51] Int. Cl.[7] ..... E04B 2/24

[52] U.S. Cl. ..... 52/437; 52/438; 52/439; 52/580

[58] Field of Search ..... 52/79.14, 264, 52/437, 438, 439, 656.2, 656.3, 656.5, 742.14, 745.19, 580, 582.1

[56] References Cited

U.S. PATENT DOCUMENTS

| | | | |
|---|---|---|---|
| 2,206,350 | 7/1940 | Gerlach | 52/438 |
| 2,411,011 | 11/1946 | Troiel | 52/437 X |
| 2,644,997 | 7/1953 | Billings | 52/439 X |
| 3,434,263 | 3/1969 | Beckman et al. | 52/438 X |
| 3,436,886 | 4/1969 | Nowak et al. | 52/656.2 X |
| 3,828,502 | 8/1974 | Carlsson | 52/438 X |
| 3,996,714 | 12/1976 | Hazelett, Jr. . | |
| 4,249,354 | 2/1981 | Wynn | 52/439 X |
| 4,463,531 | 8/1984 | Iorio Peretto | 52/264 X |
| 4,532,745 | 8/1985 | Kinard | 52/439 X |
| 4,970,838 | 11/1990 | Phillips . | |
| 5,619,823 | 4/1997 | Ruff et al. | 52/656.2 X |

FOREIGN PATENT DOCUMENTS

| | | |
|---|---|---|
| 2206420 | 6/1974 | France . |
| 2464340 | 3/1981 | France . |
| 2407727 | 9/1975 | Germany . |
| 683767 | 12/1952 | United Kingdom . |

*Primary Examiner*—Carl D. Friedman
*Assistant Examiner*—Timothy B. Kang

[57] ABSTRACT

The invention relates to a building comprising prefabricated components formed as wall and ceiling panels which are produced with a frame; the frame is an assembly of beam and angle parts which are held together and filled with a building material, such as mortar, concrete or Torcret, so as to form a flat panel.

21 Claims, 12 Drawing Sheets

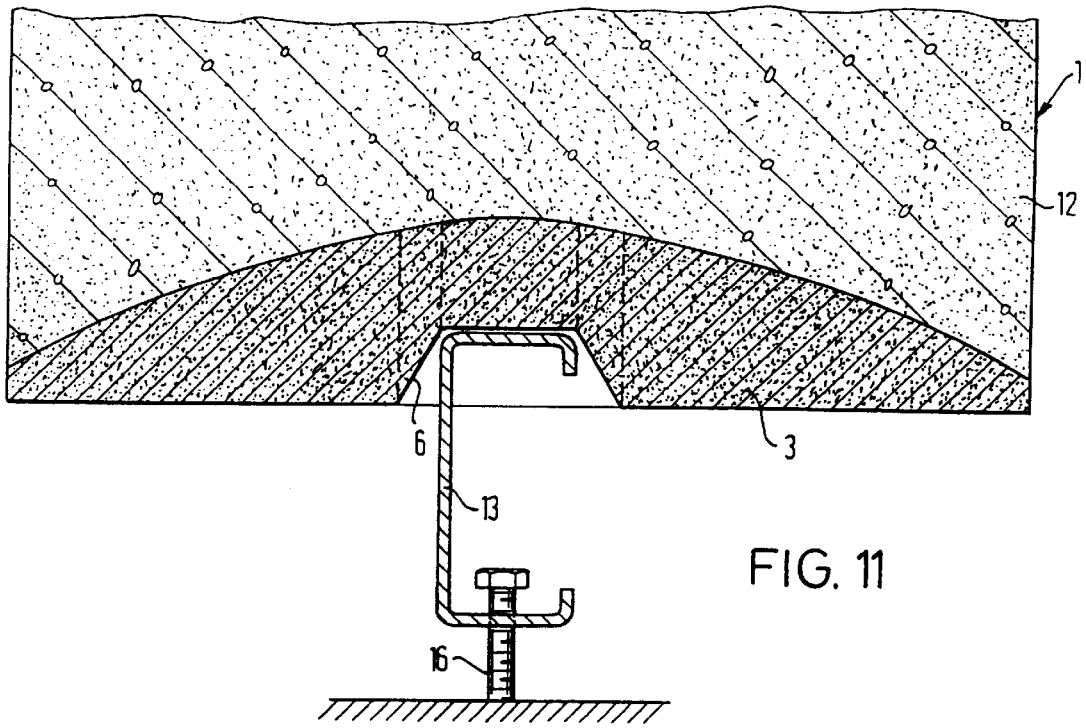
FIG. 11
FIG. 12
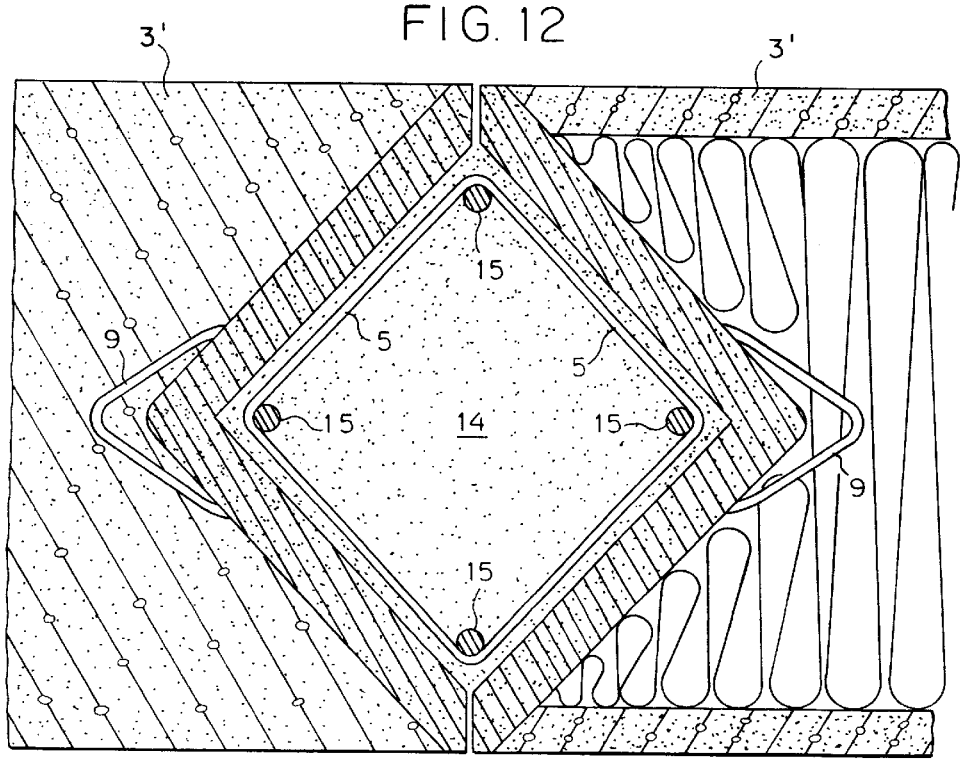

BUILDING, COMPRISING PREFABRICATED COMPONENTS

BACKGROUND OF THE INVENTION

The invention relates to a building comprising prefabricated components, these components, in particular wall and ceiling panels, being fabricated with the aid and a shell, and this lost shell being produced from semifinished parts.

As general prior art, it is already known to erect buildings made of prefabricated parts. Constructing such buildings is fast but usually expensive. These expenses involve high wage expenses, costs for furnishing formwork, lifting equipment, transport costs, and other secondary costs.

OBJECT OF THE INVENTION

By comparison, it is the object of the present invention to create a building which can be constructed quickly and inexpensively from a commercial standpoint and nevertheless has a long life.

SUMMARY OF THE INVENTION

According to the invention, this object is attained in that these semifinished parts are beams and angle elements forming the sides of the prefabricated components. This has the advantage that the building made of prefabricated components can be built quickly and inexpensively, since the aforementioned costs are reduced considerably. The less formwork is needed, for instance, the lower the costs are for furnishing these shells. Moreover, compared with the known prior art, there are fewer formwork faces to be installed and dismantled, which results in a reduction in wage expenses.

The semifinished parts are advantageously produced resting on formwork, preferably in the area of the construction site, in handy sizes. These semifinished parts or frames may be available in various sizes, which are so light in weight that they can be carried by hand. Next, once the mortar or Torcret concrete fill has set, the semifinished parts are put together.

So that the semifinished parts will be sufficiently rigid, they advantageously have a reinforcement of structural steel. In order also to be able to align the individual semifinished parts more easily and accurately, they are preferably provided with adjusting means, for instance in the form of sheaths and arbors, or tongues and grooves. Openings for doors, windows, cutouts and so forth, are inserted into the corresponding semi-finished parts.

The semifinished parts, set up and aligned, are joined by wire or connection reinforcements and are then fixed with Torcret or mortar at the connecting points. Once the Torcret material or mortar has set, the shell can be filled with filler product, such as concrete, lightweight concrete, or other construction materials. The possibility also exists for the shell to serve as a form box for brick building blocks or other blocks or various kinds of filler product. The thus-furnished part is a prefabricated component, in particular, a wall, ceiling or roof panel for buildings of all kinds.

The semifinished parts have profiled features, preferably conical indentations, which afford space for structural reinforcement and casting composition and for transferral aids. These transferral aids may be continuous, horizontal metal profiles with adjustable-height elements, such as screws, or they may be reinforcing irons or profile steel for the vertically extending alignment of the prefabricated components and securing against tilting, and may also be complete transfer gauges for complete alignment of the prefabricated components in any desired position, including in an inclined position.

A faster course of work can alternatively be attained by providing that a steel tape is wrapped around the entire shell in the outer region, preferably resting in the conical groove of the semifinished parts. If the steel tape is dimensioned adequately, then filling of the shell elements can immediately be begun. Thus the time saved for Torcret setting at the connecting points is saved.

Instead of the steel tape, the possibility alternatively exists of holding the semifinished parts together with the aid of squared timbers or steel girders. Then the applicable part can be filled on the same day or immediately thereafter. Another characteristic results from the fact that the semifinished part has a greater intrinsic weight than previously known constructions. This means that when the shell is filled, floating during concreting if the shell is shaken does not occur as easily, since the intrinsic weight is increased by the additional weight of the steel girder or wooden bar.

If the shells are very long, then it is alternatively possible within the scope of the invention to attach a tie rod at certain intervals, to prevent kinking of the side walls. This tie rod may be made of structural steel (round steel), for instance, which is secured on both sides with a formwork turnbuckle.

In a further feature of the invention, the semifinished parts can each be installed as formwork in mitered fashion at the corners, so that they are also put together in mitered fashion. The part can then advantageously be produced without corner pieces. Proceeding in this way has the advantage that users can more easily join together the individual parts.

In a further characteristic of the invention, lightweight concrete may be provided to produce the semifinished parts, as an alternative to filler concrete or mortar; this has the advantage that the outer walls have no cold bridges or in other words that the individual parts have a thermal insulation effect.

To join together the individual semifinished parts or for accurate-fit adjustment, indentations or recesses may be provided on the ends, in a further feature of the invention, into which indentations or recesses flat irons or round steel can be placed with accurate fit when the parts are put together.

The possibility also exists of providing perforations on the ends of the semifinished parts; the perforations extend through the entire wall thickness of the parts and are preferably located in the region of the conical indentations. When the semifinished parts are put together, a steel hoop of round steel is then bent (in a U) through the perforations; the ends of the hoop are then bent over on the inside of the shell and thus hold the parts together.

The possibility exists of providing a double-row arrangement of perforations, preferably in the region of the conical indentations, which results in improved adjustment and an improved hold.

BRIEF DESCRIPTION OF THE DRAWINGS

FIG. 11, a section through a semifinished part and a wall panel, the bottom region, with adjusting elements, in vertical section;

FIG. 12, a horizontal section through two adjoining ends of semifinished parts and wall panels of FIG. 2*c*.

DETAILED DESCRIPTION OF THE INVENTION

The preferred embodiment of the invention is described in detail with reference to the drawings.

Figure 1:
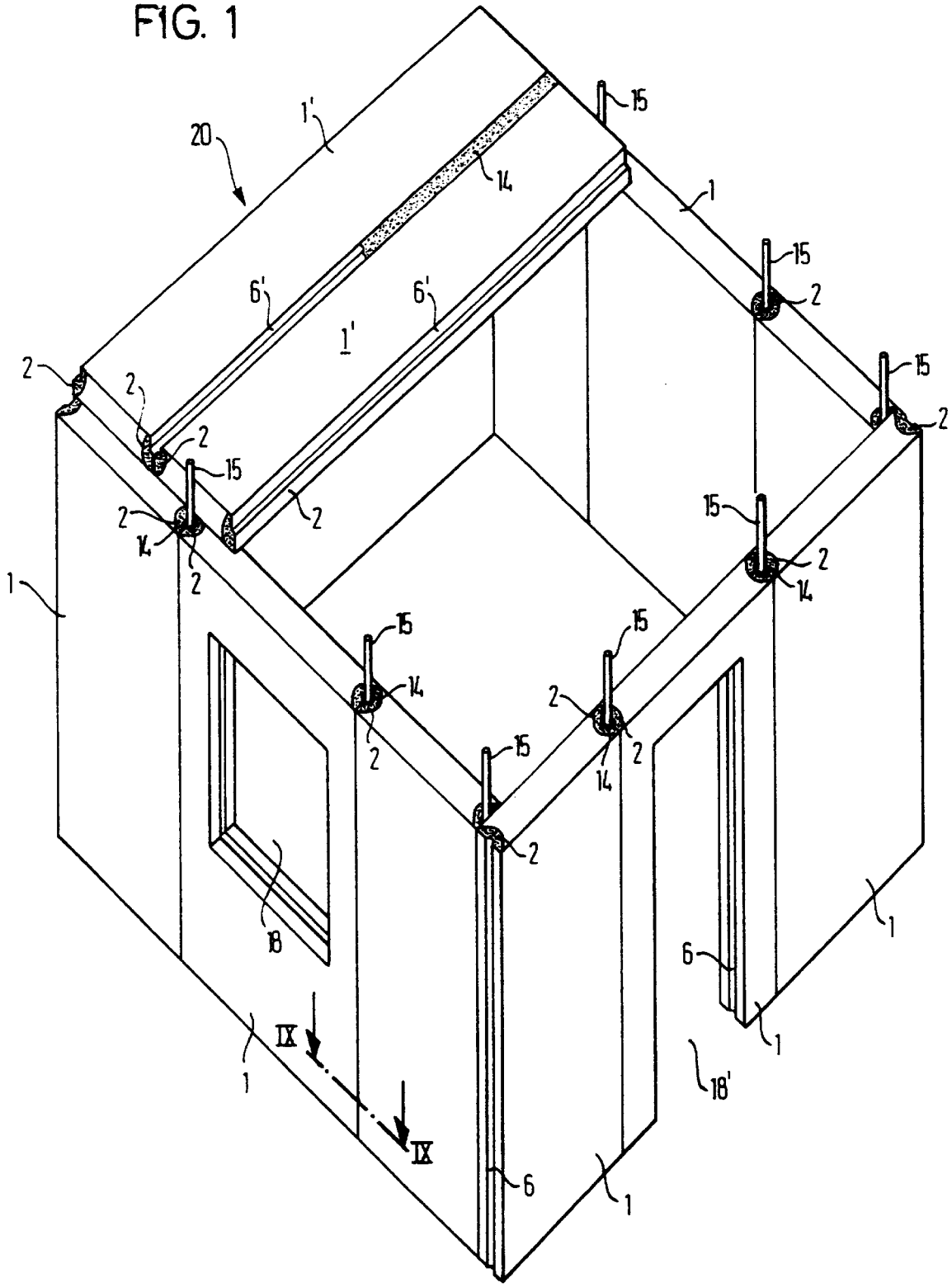
FIG. 1, a perspective view of a schematically illustrated building.

FIG. 1 schematically shows a building 20, which comprises components 1 and 1' prefabricated with the aid of a shell 2. This shell is produced from semifinished parts 3, 3' and 3"; these semifinished parts, shown in greater detail in the ensuing drawing figures, form only the ends or short sides of the prefabricated components 1 and 1'.

These components 1 may be provided with cutouts 18 for windows or 18' for doors. Each of these components 1 has a conical indentation 6, to be described in further detail hereinafter, which can be filled with casting composition 14.

Transferral aids 15 may be located in the region of the shell 2 as well, which in the form of structural steel protrusions, for instance, protrude past the various components 1 and act as reinforcing irons. The ceiling construction of the building 20 may likewise according to the invention comprise prefabricated components 1', which in turn are embodied such that the shell is made from semifinished parts, and these semifinished parts in turn are used only at the ends or short sides of the prefabricated components 1'. Each of these components 1' has an indentation 6', to be described in detail hereinafter. To adjoining indentations 6' of adjacent components 1' thus form a space that can be filled with casting composition 14.

Figure 2A:
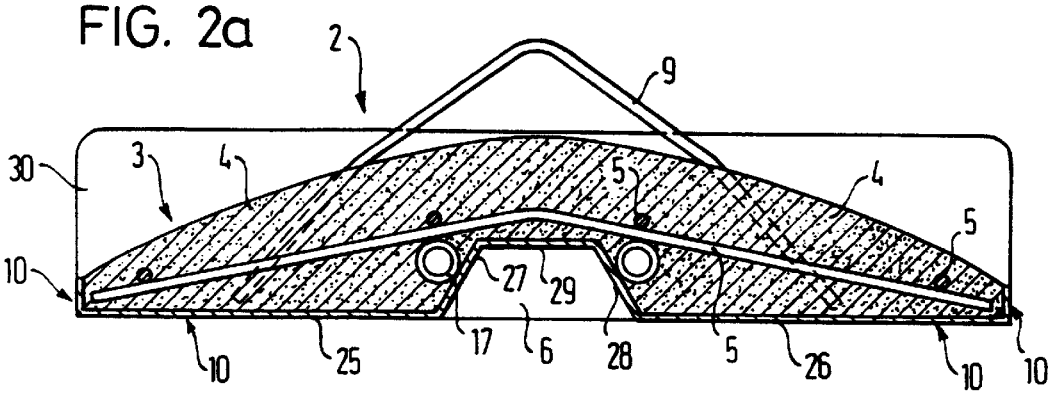
FIG. 2*a*, a side view of a semifinished part disposed in a form shell, in a vertical center section.

FIG. 2*a*, in a vertical section, shows the preparation of a semifinished part 3: As can be seen, a form shell 10 which in cross section has two flat faces 25 and 26 is used on the inside, these two faces, between 25 and 26, merge with two faces 27 and 28 inclined to one another, which are bounded in the upper region by a further flat face 29. The faces 27, 28 and 29 serve to create profiling for the semifinished part 3, in the form of a conical indentation 6. This conical indentation serves to receive casting composition 14 or transferral aids 15 shown in FIG. 1.

Figure 2B:
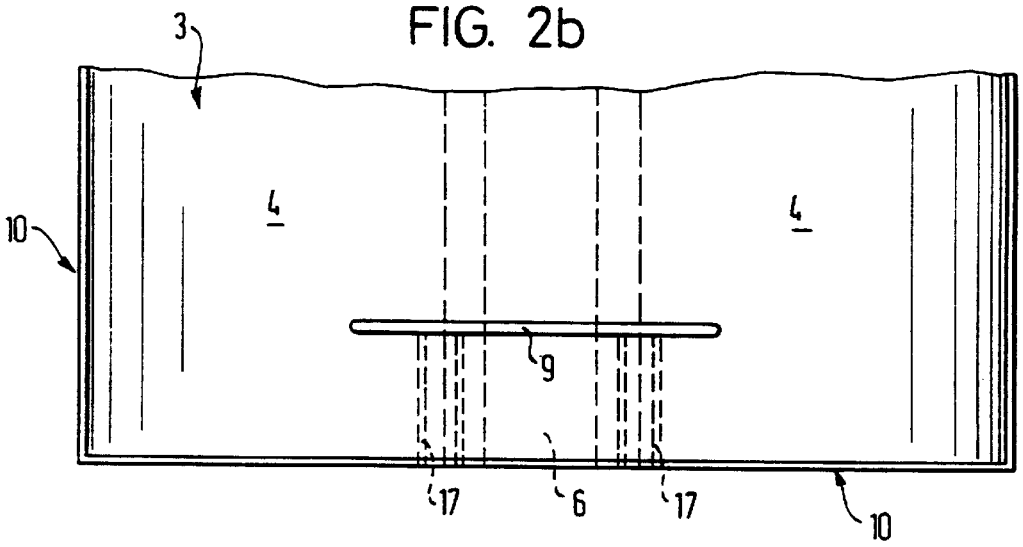
FIG. 2*b*, a plan view on the semifinished part of FIG. 2*a*, shown in fragmentary form.

The form shell 10 is bounded on its end regions by boundary walls 30. Mortar 4 or TORCRET, a concrete mortar type material, introduced into this form shell 10; adjusting elements 17 and structural steel reinforcements 5 are also embedded in this material. Moreover, as shown in FIGS. 2*a* and 2*b*, connecting or transport loops 9 can be embedded in the material 4 on the end.

Figure 2C:
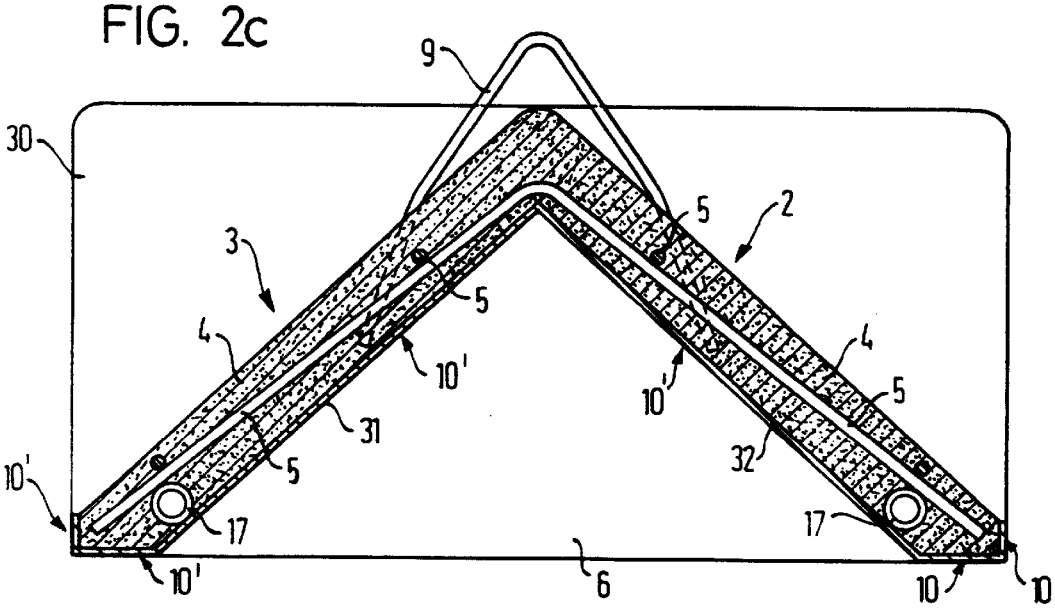
FIG. 2*c*, a semifinished part disposed in a form shell in a vertical center section in another embodiment.

In the embodiment of FIG. 2*c*, the formwork shell 10' may be embodied such that it has substantially faces 31 and 32 at right angles to one another, which are bounded by side walls 30. Once again, mortar or TORCRET is cast into this formwork shell 10', and structural steel reinforcements 5, along with connecting and transport loops 9 and adjusting elements in the form of sheaths 17 are embedded in the material.

Once the mortar 4 or TORCRET has set, the semifinished parts 3 can be removed from the respective formwork shell 10 or 10'.

Figure 4:
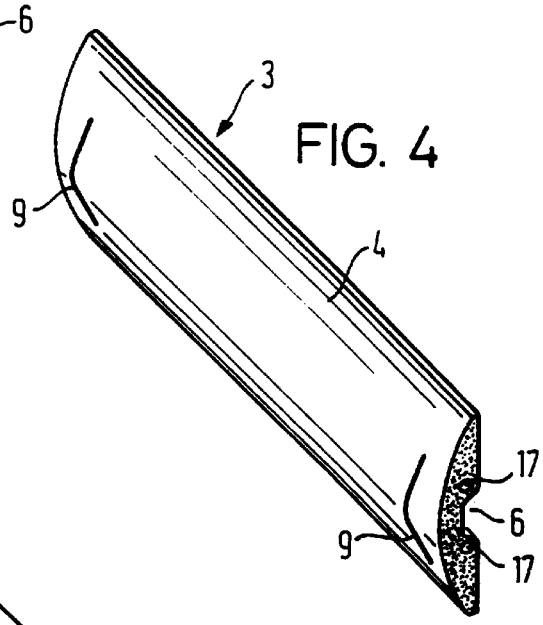
FIG. 4, a semifinished part embodied as a beam, in a perspective view.

In FIG. 4, a beam is involved as an example of a semifinished part 3; in its end regions, it has the connecting or transport loops 9, and it is provided on the outside with the conical indentations 6.

Figure 3:
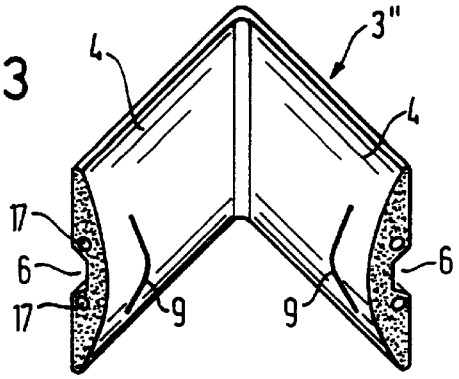
FIG. 3, a semifinished part embodied as an angle element, shown in perspective.
Figure 5:
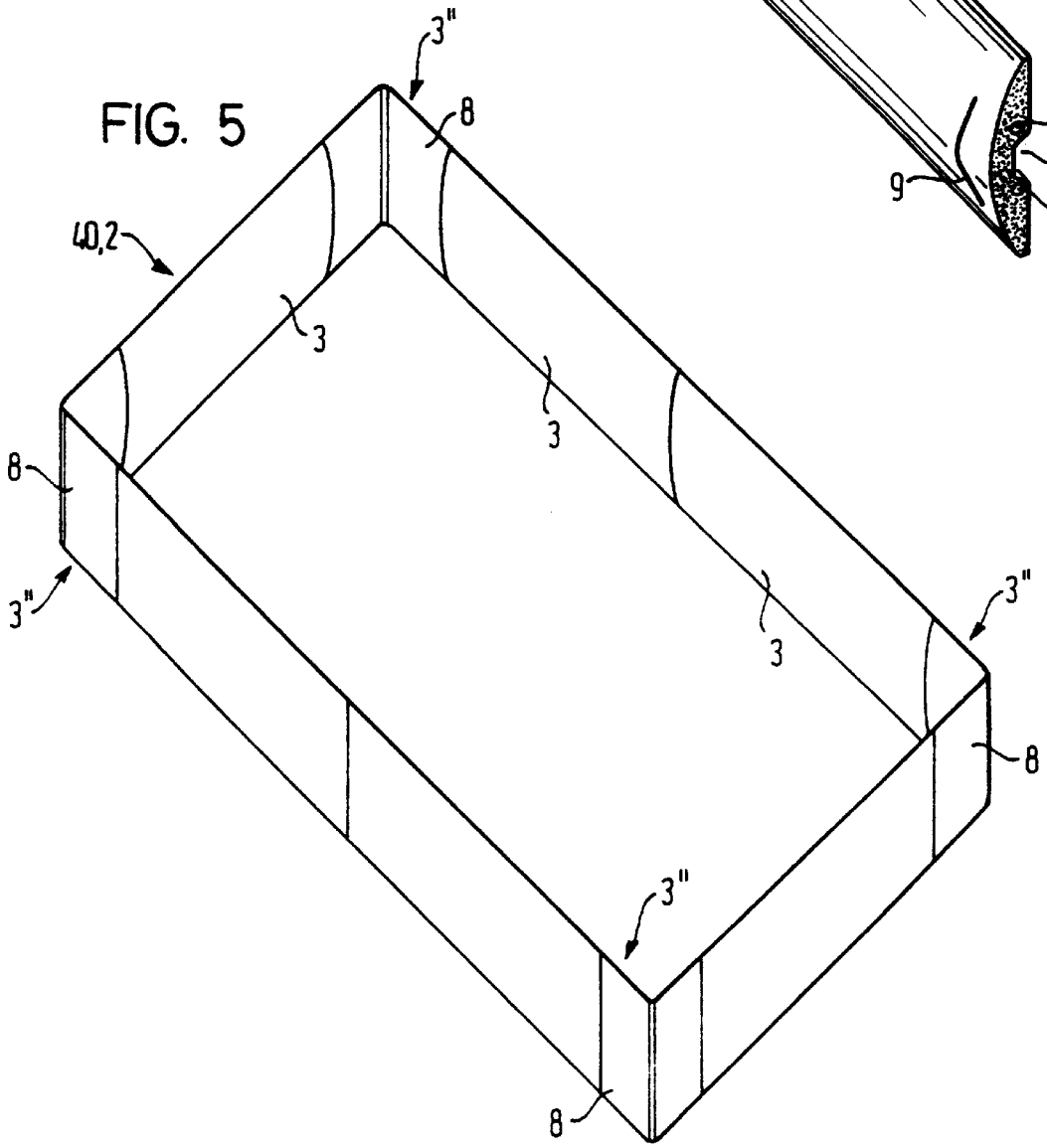
FIG. 5, a frame made of semifinished parts, shown in perspective.
Figure 3A:
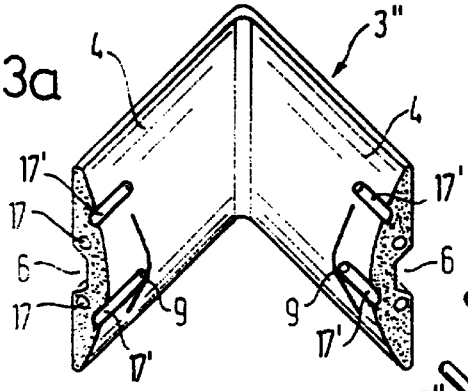
FIGS. 3*a*, another possible embodiment of the design of the angle element, shown in perspective.
Figure 4A:
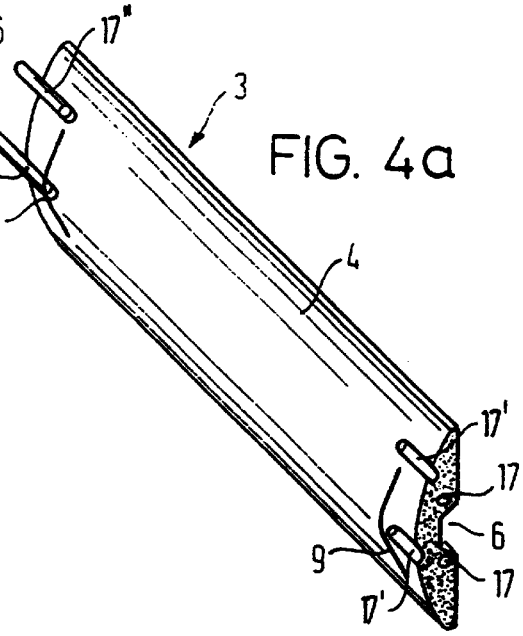
FIG. 4*a*, another possible embodiment of the semifinished part, embodied as a beam, shown in perspective.

In FIGS. 3 and 5, the possibility also exists of embodying the semifinished parts 3" as angle elements 8, once again with the corresponding conical indentations 6, loops 9, and adjusting means 17. FIGS. 3*a* and 4*a* show recesses 17' which are each made in the end regions of the semifinished parts 3 and 3", respectively. Profile elements 17", for instance of flat iron or round steel, can be placed with an accurate fit when the parts are put together; they replace or supplement the adjusting means 17.

Figure 6:
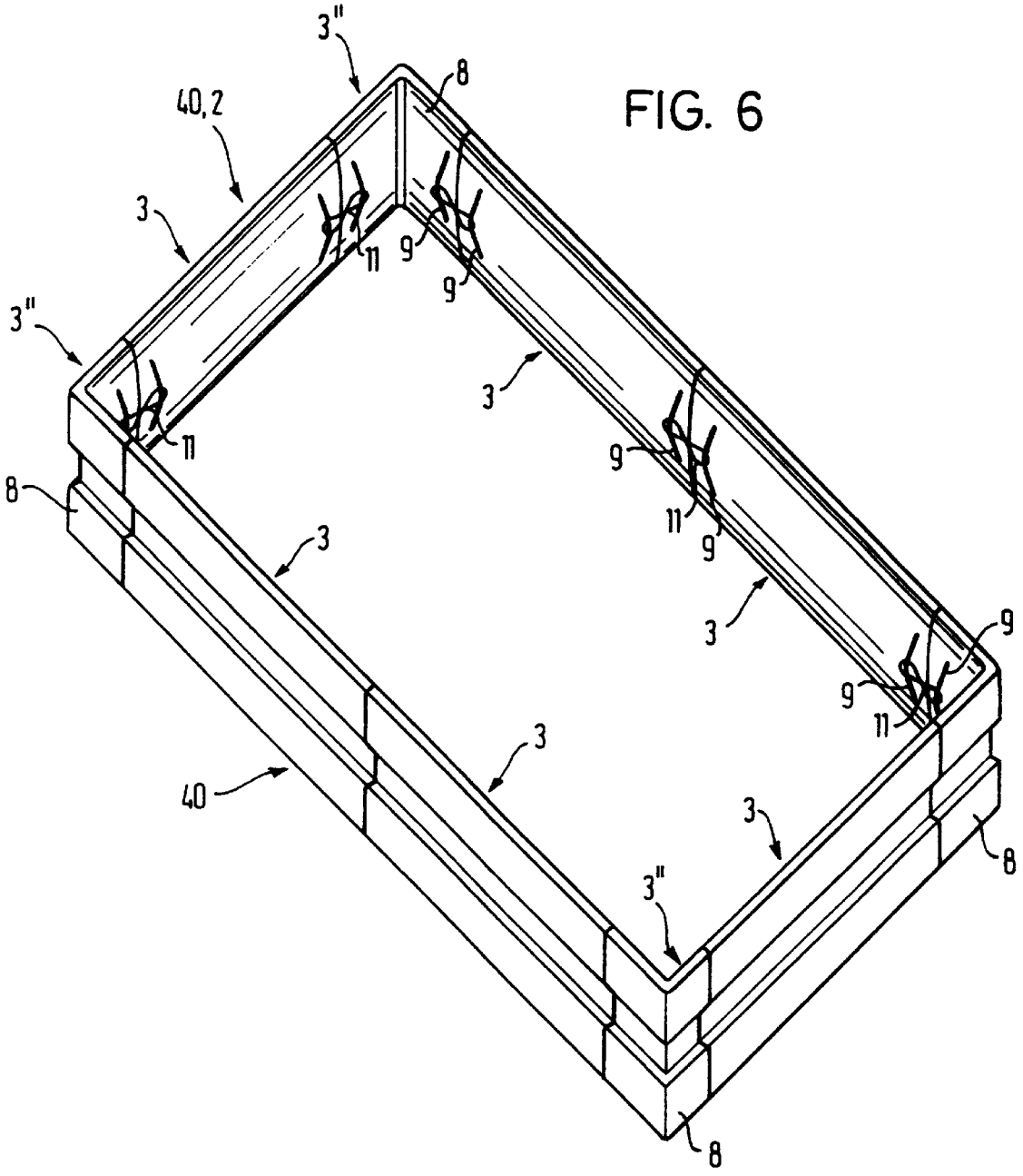
FIG. 6, a more-detailed view of the frame of FIG. 5, shown in perspective.

The angle elements 8, which are formed of the semifinished parts 3", and the beams formed of the semifinished parts 3 can be put together as shown in FIG. 5 to form a frame 40. This frame 40 is shown in further detail in FIG. 6; it can be seen there that on the ends of the angle elements 8, or beams, the loops 9 are joined together via connections 11 in the form of structural steel or wire, the overall result being a frame 40 made ahead of time, which is provided on its outside, for instance all the way around, with the conical indentation 6 and which represents the shell 2.

Figure 5A:
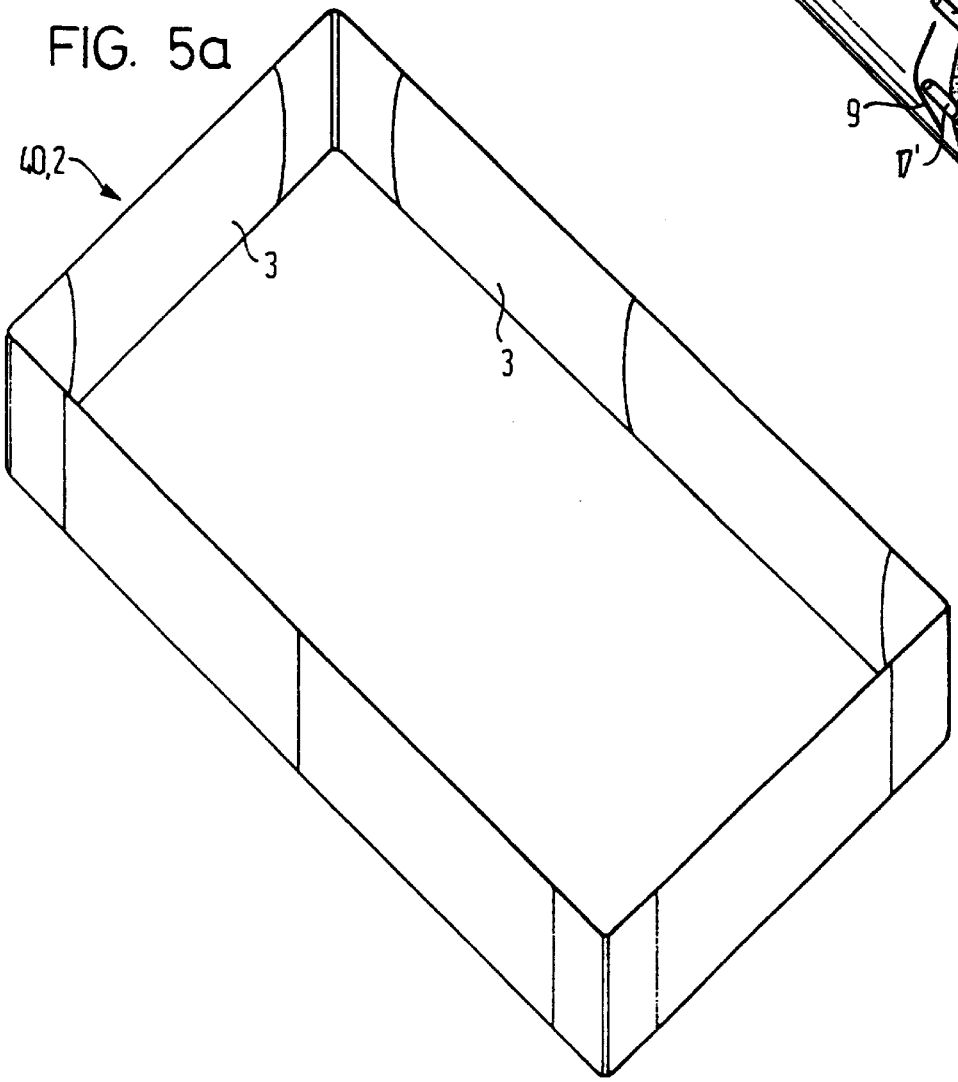
FIG. 5*a*, a frame made of semifinished parts, shown in perspective, in another possible embodiment.

In FIG. 5*a*, the frame may also be embodied such that only semifinished parts 3 that are installed in the formwork in mitered fashion at the corners are used, so that they are also put together in mitered fashion. Advantageously, the frame 40 can then be made without the corner pieces. Proceeding in this way has the advantage that the user can join the semifinished parts 3 in a simplified way to form the frame 40.

Figure 6A:
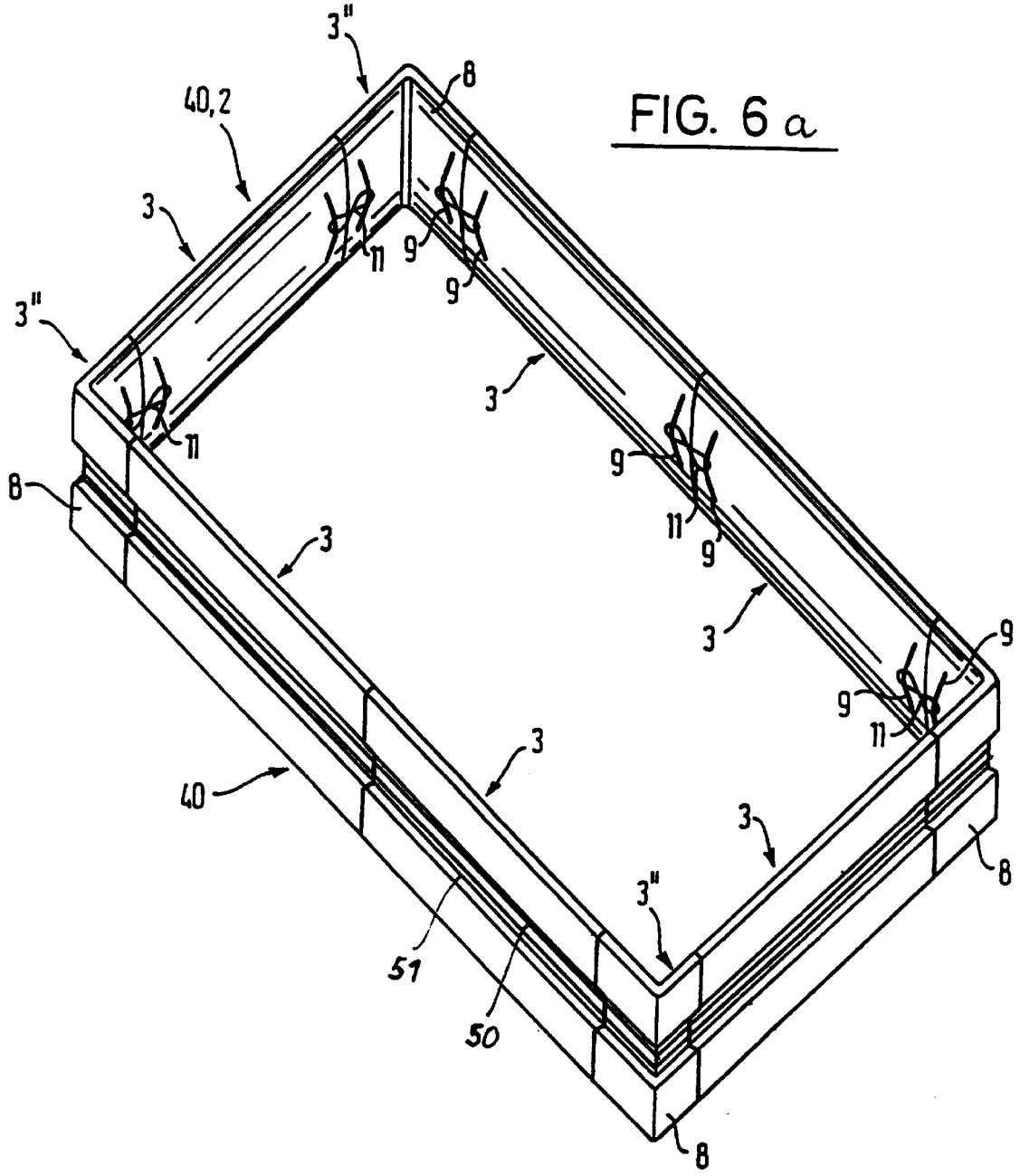
FIGS. 6*a, b, c*, various possible embodiments of the frame, own in perspective.

This frame is shown alternatively in FIG. 6*a* in detail: This figure shows a frame, which is put together from the semifinished parts 3 and 3" and joined together with connections 11 via the loops 9. If fast work is desired, then as an alternative to FIG. 6, a steel tape 50 can be placed around the entire frame in its entire region, holding together the semifinished parts like a ring. This ring is preferably located in a groove 51, or in other words in the conical indentation 6 of the semifinished parts 3 and 3".

If the ring 50 is adequately dimensioned, then the work of filling the formwork element can be begun immediately. This saves the setting time that would be involved if TORCRET were applied at the connecting points in the region of the elements 9 and 11.

Figure 6B:
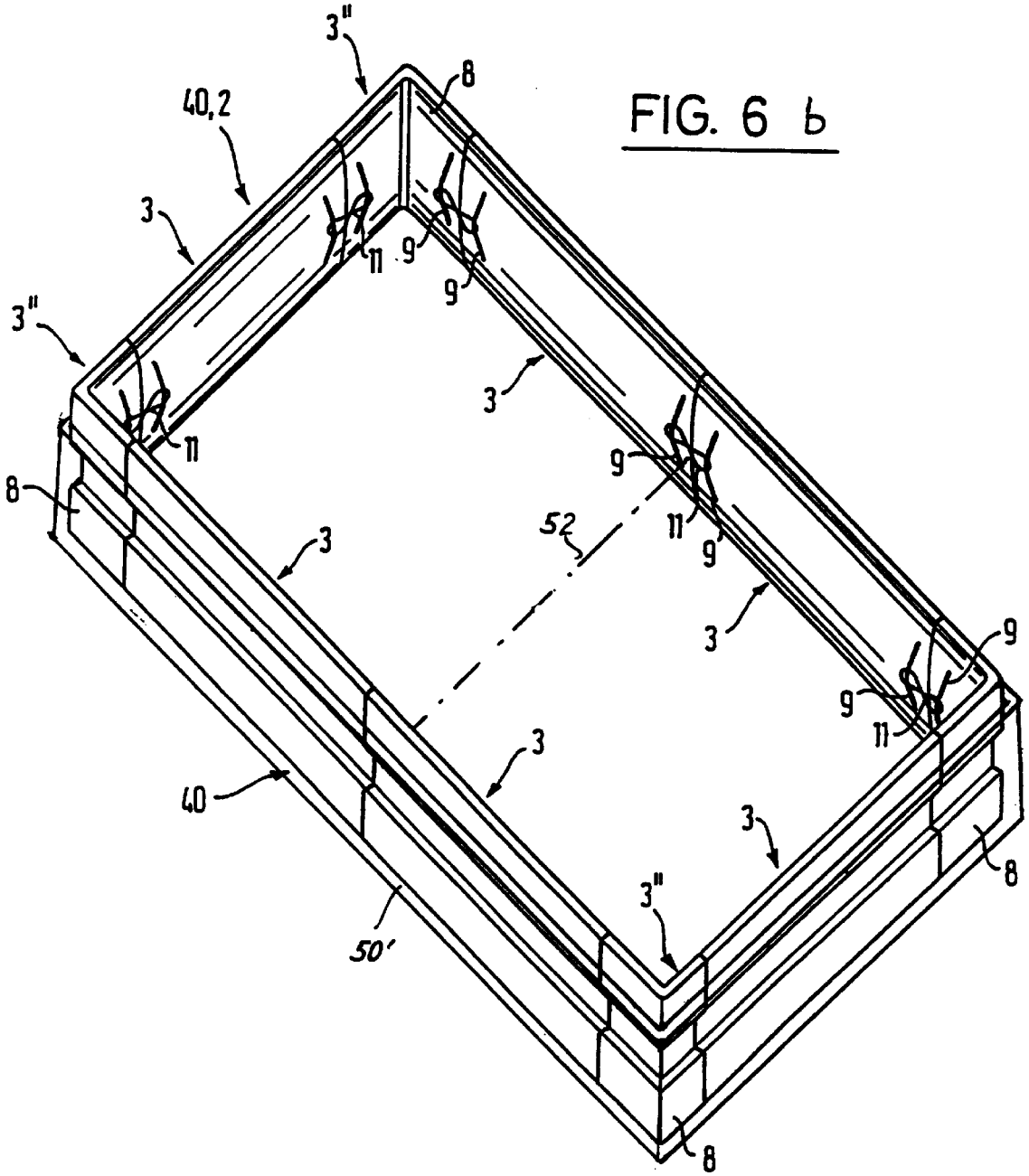

In FIG. 6*b*, the possibility alternatively exists of joining together the semifinished parts 3 and 3", or holding them together in ringlike fashion, using squared-shaped timbers 50' or steel girders, which have the same effect as the ring 50 of FIG. 6*a*. Advantageously, the semifinished parts are held together thereby, so that the part can be filled or concreted on the same day or immediately thereafter. Another advantage here is that the frame has a greater intrinsic weight; this means that when the shell is filled, floating during concreting or shaking does not occur easily, since the intrinsic weight is increased by the additional weight of the steel girders or wooden bars.

If the frames are very long, it is appropriate to provide a tie rod 52 at certain intervals, as shown in FIG. 6*b*, to prevent kinking of the side walls of the semifinished parts 3 and 3'. This tie rod 52 may be a structural steel (round steel), which is secured on both sides with a formwork turnbuckle, not shown in further detail.

Figure 6C:
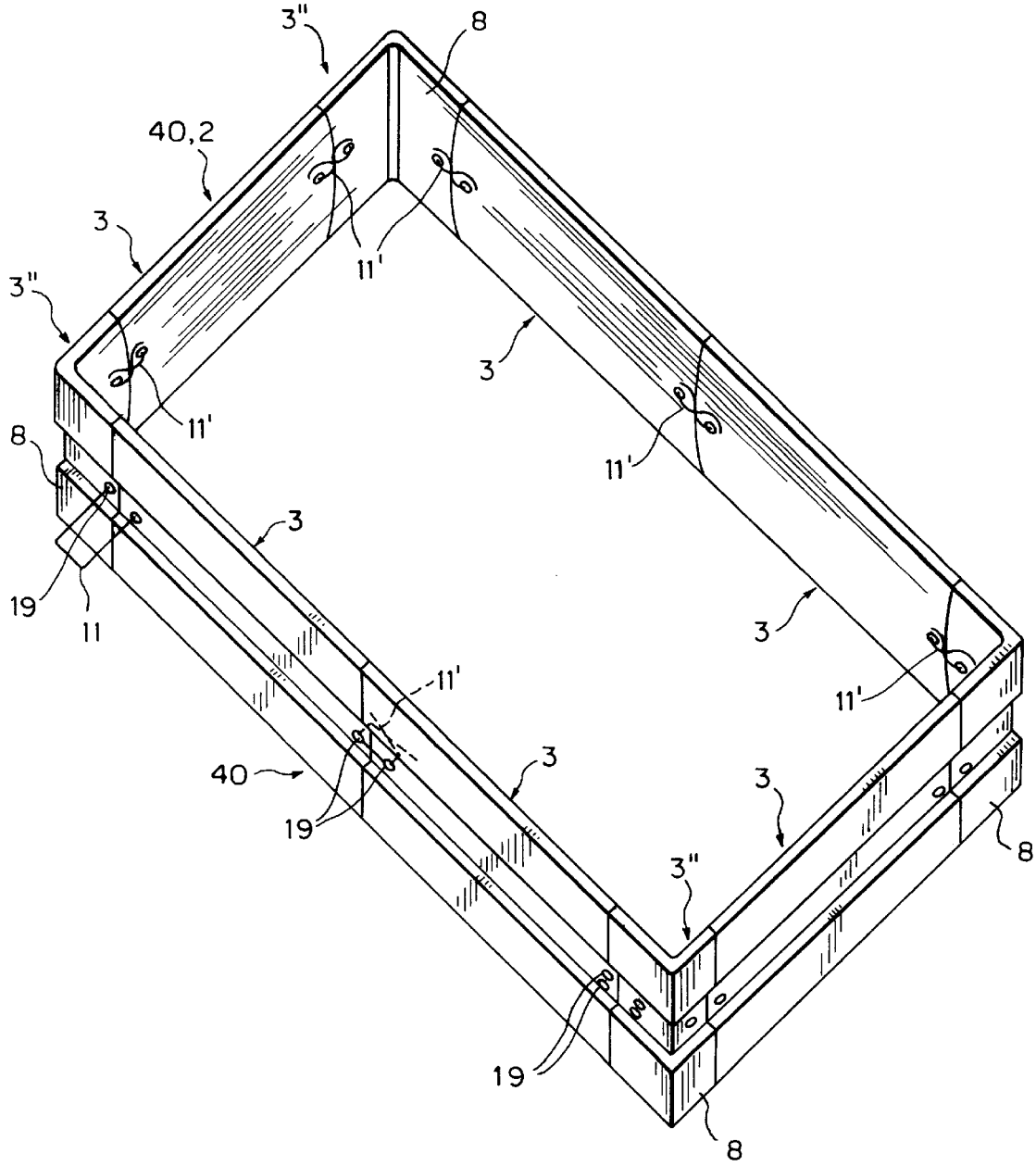

In FIG. 6*c*, the possibility exists of providing perforations 19 on the ends of the semifinished parts, which extend through the entire wall thickness of the semifinished parts and are preferably each located in the region of the conical indentations 6.

When the semifinished parts 3 and 3" are assembled, a steel hoop 11' of round steel (bent in a U) is then thrust through the perforations; on the inside of the shell 40, the ends of the steel hoops 11' are bent over and thus hold the semifinished parts together. The loops 9 in connections 11 shown in FIG. 6 can thus be omitted.

In FIG. 6*c*, in the lower right region, a double-row arrangement of perforations 19 is also shown, which are preferably always located in the region of the conical indentations 6. This provides improved adjustment and a stronger hold.

Figure 7:
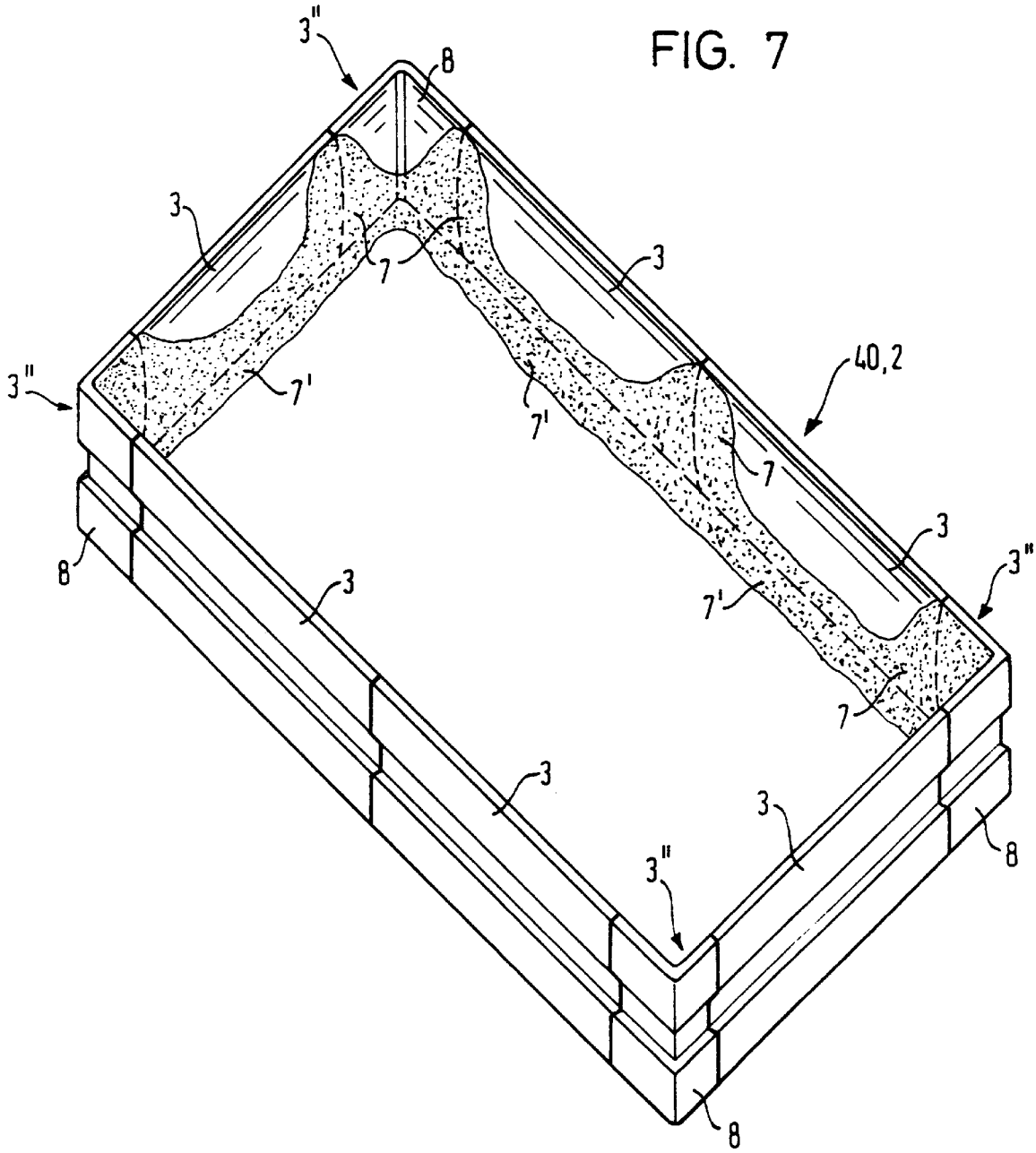
FIG. 7, a frame, prepared as shown in FIGS. 5 and 6, comprising semifinished parts with fixation provided by Torcret concrete or mortar at the connecting points, shown in perspective.

In FIG. 7, this frame 40 is fixed on the inside, at least to the regions of the adjoining ends of the beams 3 and angle elements (3"), with TORCRET 7 and 7', respectively, or with mortar. As a result, it is advantageously attained that the frame 2 is rigid and dimensionally stable, and will not float upward when filled with filler product.

Figure 8:
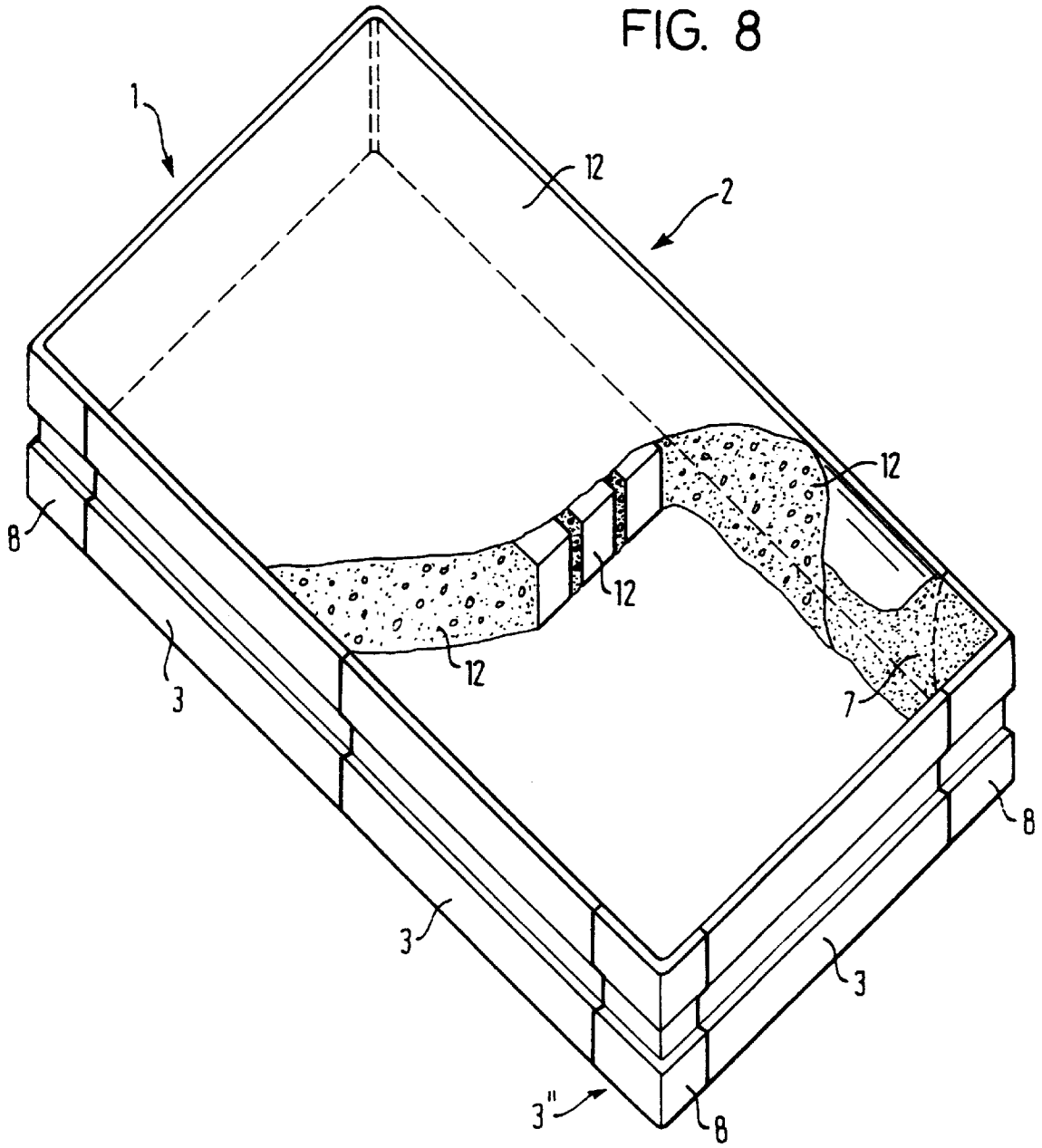
FIG. 8, a component comprising semifinished parts in accordance with the present invention, shown in perspective and partly cut away.

Once the TORCRET material 7 or 7' or the mortar has set, then as shown in FIG. 8 the shell 2 can be filled with filler product 12, for instance in the form of concrete, lightweight concrete or other construction materials.

It is also possible for these frames to be filled as form boxes or brick assembly building blocks.

This frame can also serve as a form box for brick assembly building blocks or other building blocks or for filler products of all kinds.

The part, now set as shown in FIG. 8, is a prefabricated component 1, which can be used for buildings 20 of any kind.

Figure 9:
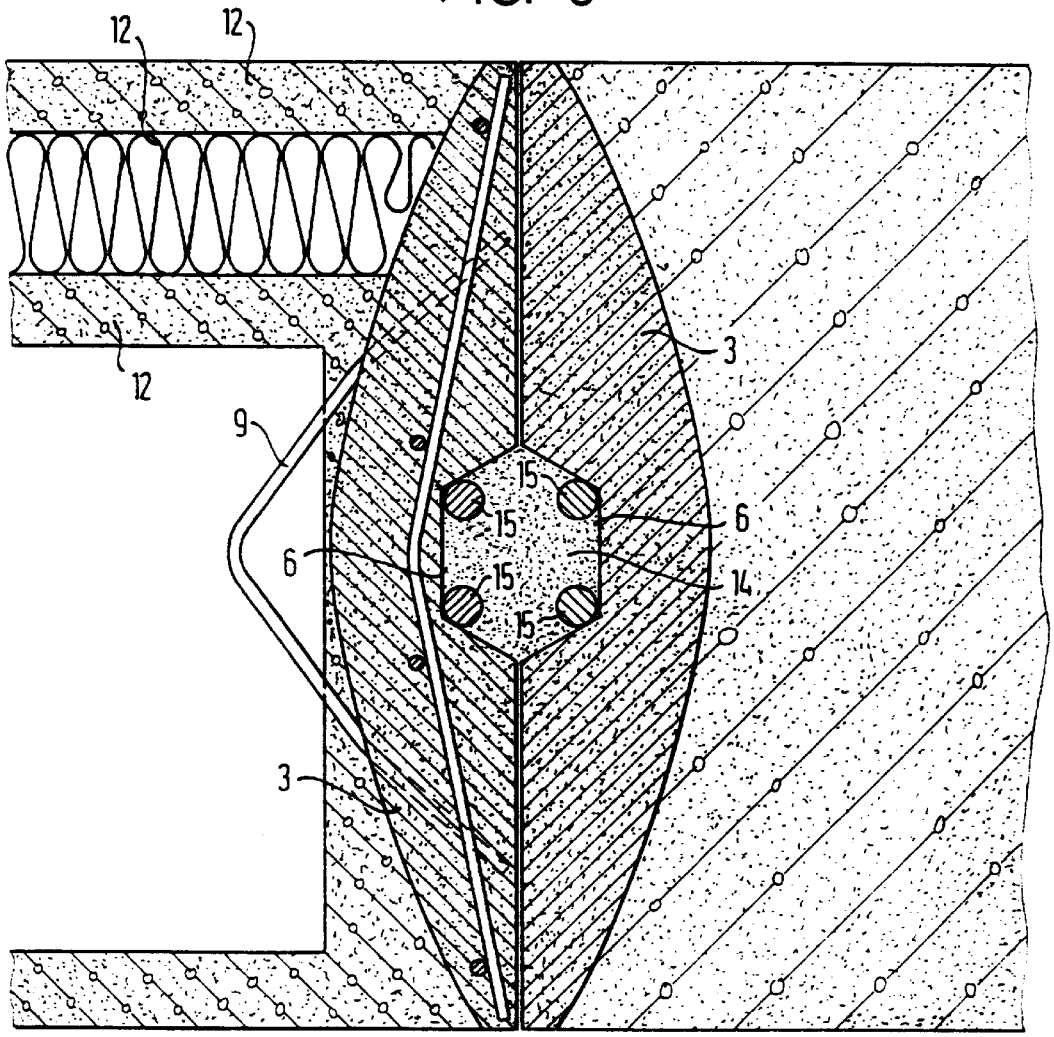
FIG. 9, a section taken along the line IX—IX of FIG. 1.

FIG. 9 shows a section along the line IX—IX of FIG. 1. As can be seen, by means of the opposed conical indentations 6 of the semifinished parts 3, a space is created which can be equipped with transferral aids, for instance in the form of reinforcing irons 15. Casting composition 14 is also introduced into this space and joins the two adjoining semifinished parts 3 and thus the component 1 to one another.

Figure 10:
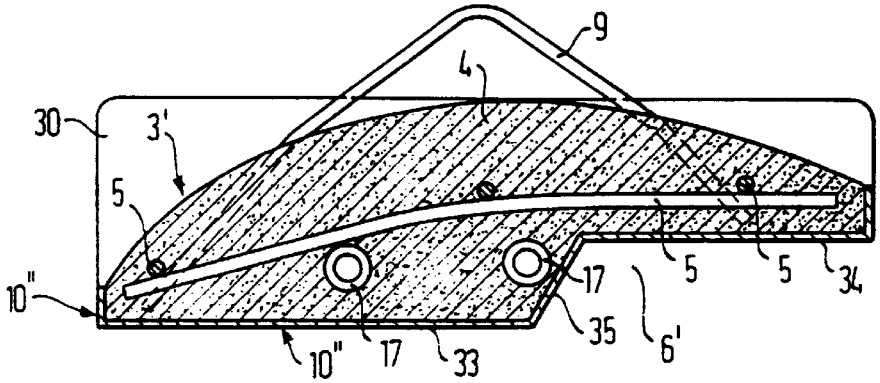
FIG. 10, a semifinished part, disposed in a form shell, that can be inserted in a sealing panel, in a vertical section.

In FIG. 10, the possibility also exists of providing a part, as the formwork shell 10", which has two flat faces 33 and 34, offset in height from one another, which are joined together by an inclined face 35. There is also one boundary wall 30 in each end region, analogously to the embodiment of FIG. 2*a*.

With the aid of this formwork shell 10", a semifinished part 3' can be made which serves as part of the frame for producing a ceiling panel 1' of FIG. 1. Analogously to the embodiments described above, this semifinished part 3' is provided with reinforcements 5, transport and connection loops 9, and adjusting means 17. Once the mortar 4 in the formwork shell 10" has set, this semifinished part 3' can be lifted out of the formwork shell 10", and since it is provided with the indentation 6' and the other elements, it can form the basis for making a component 1', analogously to the descriptions of FIGS. 3–8.

FIG. 11 shows a semifinished part 3 in the bottom region. As can be seen, a horizontal metal profile 13, which for instance is continuous, is placed in the conical indentation 6 and in its lower region has an adjustable height element, for instance in the form of a screw. It is thus possible to adjust the component 1 functionally properly relative to the floor.

FIG. 12 shows two abutting ends of semifinished parts 3', of the kind made by the formwork shell of FIG. 2*c*. As can be seen, there is a large interstice, which is filled both with casting composition 14 and with transferral aids 15 and reinforcements 5. The casting composition 14 can serve here as a load-bearing support.

In all the structural forms, the possibility also exists that the transferral aids 13 or 15 can act as a subconstruction or as fastening devices for protective and work scaffolds, or as fastening devices for lifting equipment of all kinds, so that components 1 and 1' can be moved from place to place appropriately.

To produce the semifinished parts, of the kind shown in FIGS. 2*a*, 2*b* and 2*c*, lightweight concrete can be provided as an alternative to filler concrete or mortar; this has the advantage that the outer walls have no cold bridges; that is, the parts have an insulating and especially heat-insulating action.

Overall, with the aid of the semifinished parts 3 or 3' or 3" produced in formwork shells 10 or 10' or 10", the possibility is gained of making components 1 and 1' which can be produced at low cost and thus make an overall contribution to reducing the costs of a building 20.

I claim:

1. A building constructed with prefabricated panels, these panels being used to form walls and ceilings, each panel including a permanent formwork which cannot he used again, and which formwork is produced from semi-finished parts, each of said panels comprising:

a plurality of beams;

a plurality of angle pieces;

said beams and angle pieces being initially assembled by connection means near the inside of adjoining ends of a beam and an angle piece;

said connection means being loops near the inside of adjoining ends of the beam and angle pieces and means for tying the loops together to generate a formwork;

first means for partially filling an inside space of the formwork near adjacent ends of the beam and angle pieces;

a groove on the outside of the formwork encompassing an outer circumference; and a ring encompassing the outer circumference whereby said formwork is made rigid and dimensionally stable.

2. The building constructed according to claim 1, wherein the prefabricated panel includes second filling means for completely filling the frame so as to generate a flat panel.

3. The building constructed according to claim 2, wherein said first and second filling means is mortar.

4. The building constructed according to claim 2, wherein said first and second filling means is a concrete material.

5. The building constructed according to claim 1, wherein the ring is a band of steel.

6. The building constructed according to claim 5, wherein the groove is in the form of a conical indentation, and said band of steel is disposed in the groove.

7. The building constructed according to claim 1, wherein the ring is embodied as a wooden bar.

8. The building constructed according to claim 1, wherein the ring is embodied as a steel girder.

9. The building constructed according to claim 1, further including at least one tie rod disposed between opposite beam elements forming said form work.

10. The building constructed according to claim 9, wherein the tie rod is formed of structural steel and is secured by at least one end to an adjacent beam element via a turnbuckle.

11. The building constructed according to claim 1, wherein the beams and angle pieces are produced from lightweight concrete.

12. The building constructed according to claim 11, including transferral aids which are horizontal metal profiles, reinforcing irons and securing devices for lifting tools and the framework is further provided with height-adjustable elements.

13. The building constructed according to claim 1, wherein the loops of said beams and angle pieces can be used for moving the elements from place to place.

14. The building constructed according to claim 1, wherein the beam and angle pieces are each mitered at their ends and put together in mitered fashion.

15. A building constructed with prefabricated components, these components being used as wall and as ceiling panels each of said components comprising:

a plurality of beam elements;

a plurality of angle elements, each of the beam and angle elements including connecting loops;

a beam and an angle element being joined together into a permanent frame;

connection means for tying the connecting loops together;

first means for partially filling an inside space of the permanent frame at least near adjacent ends of a beam and an angle element to make the frame rigid and dimensionally stable; each prefabricated component including second filling means for completely filling the frame so as to generate a flat panel; each of said beam and angle element being enclosed by a ring encompassing an outer circumference of the permanent frame; said ring being a band of steel; and said beam and angle elements each have a groove in the form of a conical indentation, said band of steel being disposed in the groove.

16. A building constructed with prefabricated components, these components being used as wall and as ceiling panels, each of said components comprising:

a plurality of beam elements;

a plurality of angle elements, each of the beam and angle elements including connecting loops;

a beam and an angle element being joined together into a permanent frame;

connection means for tying the connecting loops together;

first means for partially filling an inside space of the permanent frame at least near adjacent ends of a beam and an angle element to make the frame rigid and dimensionally stable; said beam element including perforations for the passage therethrough of connecting loops on adjoining ends; and said perforations being disposed in a groove and said groove being in the form of a conical indentation.

17. The building constructed according to claim 16, wherein said perforations are double rows, at least in one region of the beam elements.

18. The building constructed according to claim 16, wherein the ends of the beam elements have recesses into which profile elements are inserted.

19. The building constructed according to claim 18, wherein the profile elements are made of flat iron.

20. The building constructed according to claim 18, wherein the profile elements are made of round steel.

21. A building constructed with prefabricated components, these components being used as wall and as ceiling panels, each of said components comprising:

a plurality of beam elements with connecting loops at each end;

a plurality of angle elements with connecting loops at each end;

a beam and an angle element being joined together into a permanent frame;

connection means for tying the connecting loops at joined ends together;

first means for partially filling an inside space of the permanent frame at least near the joined ends of the beam and the angle element to make the frame rigid and dimensionally stable; each prefabricated component further including second filling means for completely filling the frame so as to generate a flat panel; and the beam and angle elements are each mitered near their ends and put together in mitered fashion.

* * * * *